US010414556B2

(12) United States Patent
Kim

(10) Patent No.: US 10,414,556 B2
(45) Date of Patent: Sep. 17, 2019

(54) LIQUID CONTAINER HAVING SINGLE CAP

(71) Applicant: Hak Rae Kim, Gwangju-si (KR)

(72) Inventor: Hak Rae Kim, Gwangju-si (KR)

( * ) Notice: Subject to any disclaimer, the term of this patent is extended or adjusted under 35 U.S.C. 154(b) by 0 days.

(21) Appl. No.: 15/823,557

(22) Filed: Nov. 27, 2017

(65) Prior Publication Data

US 2018/0162608 A1 Jun. 14, 2018

(30) Foreign Application Priority Data

Dec. 12, 2016 (KR) ..... 10-2016-0169017

(51) Int. Cl.

| | |
|---|---|
| ***B65D 47/14*** | (2006.01) |
| ***B65D 47/12*** | (2006.01) |
| ***B65D 39/08*** | (2006.01) |
| ***B65D 53/02*** | (2006.01) |
| ***B65D 1/02*** | (2006.01) |

(Continued)

(52) U.S. Cl.

CPC ..... *B65D 47/122* (2013.01); *B65D 1/0246* (2013.01); *B65D 1/0253* (2013.01); *B65D 39/08* (2013.01); *B65D 41/04* (2013.01); *B65D 47/121* (2013.01); *B65D 47/246* (2013.01); *B65D 51/18* (2013.01); *B65D 53/02* (2013.01); *B65D 81/3837* (2013.01); *B65D 2251/0015* (2013.01); *B65D 2251/0087* (2013.01); *B65D 2501/0009* (2013.01); *B65D 2547/066* (2013.01)

(58) Field of Classification Search

CPC .. B65D 47/241; B65D 47/142; B65D 47/121; B65D 47/122; B65D 47/246; B65D 47/245; B65D 47/263; B65D 47/247; B65D 39/08; B65D 39/14; B65D 55/165; B65D 55/16; B65D 50/061; B65D 41/0485; B65D 47/143; B65D 47/141; B65D 47/068; A47J 41/0027; A47J 41/0016

USPC ..... 220/799, 797, 800, 798, 290; 215/216, 215/306

See application file for complete search history.

(56) References Cited

U.S. PATENT DOCUMENTS 403,466 A * 5/1889 Glover ..... B65D 39/08 215/357
4,506,794 A * 3/1985 Wilson ..... B65D 50/061 215/206

(Continued)

FOREIGN PATENT DOCUMENTS

CN 204776594 U * 11/2015
GB 687895 A * 2/1953 ..... B65D 39/00

(Continued)

*Primary Examiner* — Allan D Stevens

(74) *Attorney, Agent, or Firm* — Revolution IP, PLLC

(57) ABSTRACT

A liquid container includes a container body including an inner space accommodating a liquid formed therein, a liquid port formed at a top thereof to allow the liquid to flow into/out of the inner space, and a holding protrusion which protrudes toward an inside and is formed on an inner circumferential surface thereof, a cap inserted into the liquid port and then coupled with the container body, and a stopper coupled with the cap, disposed to be spaced apart from a bottom surface of the cap, configured to protrude in an outward-radial direction and to be held by the holding protrusion to limit a movement distance of the cap when the cap moves upward, and formed of an elastic material to allow the cap to be separable from the container body by a certain external force applied to the cap.

2 Claims, 8 Drawing Sheets

(51) Int. Cl.

| | |
|---|---|
| ***B65D 81/38*** | (2006.01) |
| ***B65D 41/04*** | (2006.01) |
| ***B65D 47/24*** | (2006.01) |
| ***B65D 51/18*** | (2006.01) |

(56) References Cited

U.S. PATENT DOCUMENTS

| | | | | | |
|---|---|---|---|---|---|
| 4,582,218 | A * | 4/1986 | Ross | A47G 19/12 | 215/307 |
| D836,388 | S * | 12/2018 | Abante | D7/392.1 | |
| D836,389 | S * | 12/2018 | Abante | D7/392.1 | |
| 2003/0209574 | A1* | 11/2003 | Lin | B65D 41/0442 | 222/548 |
| 2015/0232232 | A1* | 8/2015 | Shibuki | B65D 25/14 | 220/592.16 |
| 2017/0081090 | A1* | 3/2017 | Boyer | B65D 47/121 | |
| 2018/0105346 | A1* | 4/2018 | Tolman | B65D 81/3869 | |

FOREIGN PATENT DOCUMENTS

| | | | |
|---|---|---|---|
| JP | 2006-259759 | A | 9/2006 |
| KR | 10-1581270 | B1 | 1/2016 |
| KR | 10-1668309 | B1 | 10/2016 |

* cited by examiner

LIQUID CONTAINER HAVING SINGLE CAP

CROSS-REFERENCE TO RELATED APPLICATION

This application claims priority to and the benefit of Korean Patent Application No. 10-2016-0169017 filed on Dec. 12, 2016, the disclosure of which is incorporated herein by reference in its entirety.

BACKGROUND

1. Field of the Invention

The present invention relates to a liquid container, and more particularly, to a liquid container including a single cap structure in which a cap is limited in a movement distance and simultaneously separable from a container body.

2. Discussion of Related Art

Generally, a thermos bottle is an insulation container manufactured for maintaining a drink therein at the same temperature for a long time. There are various types of thermos bottles in the market.

A thermos bottle generally includes a container body in which a drink is accommodated, a cap which selectively opens and closes the container body, and an external cover coupled with a top of the container body to externally cover the cap.

In the thermos bottle having a single cap structure configured as described above, generally, the cap is partially twisted out of the container body to discharge a drink therein.

However, in the related art, the cap is partially twisted and discharges only in a determined direction. Also, since an opening degree of the cap is not determined, when the cap is twisted too much and tilted to discharge a drink, the cap may be separated and content may be spilt such that there is a danger of burn with a hot drink or contaminating a nearby place.

Also, when the container body is tilted, the cap leans due to a weight of the cap in a direction in which the container body is tilted. Accordingly, since it is difficult to provide a flow path, a liquid therein is not easily discharged.

SUMMARY OF THE INVENTION

The present invention is provided to overcome limitations of the related art, and aspects of the present invention are as follows.

One aspect of the present invention provides a liquid container including a single cap structure capable of preventing a cap from being separated when a container body is tilted to discharge a liquid.

Another aspect of the present invention provides a liquid container including a single cap structure capable of discharging a liquid in all directions of 360 degrees.

Still another aspect of the present invention provides a liquid container including a single cap structure in which a cap is not separated when a liquid is discharged but is separable from a container body when a certain external force is applied to the cap for washing, drink-refilling, and replacing, and the like thereof.

Aspects of the present disclosure will not be limited to the above-mentioned aspects and other unmentioned aspects will be clearly understood by those skilled in the art from the following description.

According to one aspect of the present invention, a liquid container including a single cap structure includes a container body, a cap, and a stopper.

An inner space which accommodates a liquid therein is formed in the container body, a liquid port for allowing the liquid to flow into/out of the inner space is formed at a top thereof, and a holding protrusion which protrudes toward an inside is formed on an inner circumferential surface.

The cap is inserted into the liquid port and fastened to the container body to open and close the liquid port to selectively connect the inner space to an outside.

The stopper is coupled with the cap, disposed to be spaced apart from a bottom surface of the cap, configured to protrude in an outward-radial direction to be held by the holding protrusion to limit a movement distance of the cap when the cap moves upward, and formed of an elastic material to allow the cap to be separable from the container body by a certain external force applied to the cap.

The cap may include an insertion portion inserted into the liquid port and located in the container body and a handle portion located above the insertion portion and exposed outward from the container body to be gripped by a user to rotate the cap.

An extraction flow path opened and closed according to an opening and closing operation of the cap may be formed on an outer circumferential surface of the insertion portion.

The extraction flow path may have a length in a height direction of the cap and may have a groove shape recessed toward an inside of the cap.

The container body and the insertion portion may be fastened by screw-coupling.

Also, when the cap is completely closed, the holding protrusion and the cap come into contact with each other such that inflow/outflow of the liquid may be cut off. When the cap is opened, the stopper is held by the holding protrusion such that the cap may be prevented from being separated from the container body.

The cap may include a first sealing portion which has elasticity at a part in contact with the holding protrusion to be compressed by the holding protrusion to seal the inner space when the cap is completely closed.

The first sealing portion may include an elastic protrusion compressed by the holding protrusion and deformed in an inward-radial direction to increase a sealing effect when the cap is completely closed.

Also, there may be formed a second sealing portion formed of an elastic material between the insertion portion and the handle portion and extended along an outer diameter to protrude outward to come into contact with an inner circumferential surface of the liquid port and be compressed to cut off inflow/outflow of the liquid when the cap is completely closed and to open a part of the liquid port when the cap is opened.

Meanwhile, an upper part of the liquid port may be formed to allow a diameter thereof to get increased to the top.

Also, a stopper accommodation groove in which the stopper is accommodated to prevent a horizontal movement of the stopper when the cap moves upward may be formed at an edge of the liquid port on a bottom surface of the holding protrusion.

BRIEF DESCRIPTION OF THE DRAWINGS

The detailed description of exemplary embodiments of the present invention, which will be described below, and the summary described above will be better understood with reference to the attached drawings. The exemplary embodiments of the present invention are shown in the drawings to exemplify the present invention. However, it should be understood that the present application is not limited to accurate arrangements and means shown in the drawings, in which.

DETAILED DESCRIPTION OF EXEMPLARY EMBODIMENTS

Hereinafter, embodiments of the present invention will be described in detail with reference to the attached drawings. However, it will be easily understood by one of ordinary skill in the art that the attached drawings are provided to easily disclose the content of the present invention and the scope of the present invention is not limited to the attached drawings.

Also, it should be noted that throughout the description, like elements having the same function will be referred to as like designations and like references but are actually not the same as elements of the related art.

Also, the terms used herein are used merely to describe particular embodiments and are not intended to limit the present invention. Singular forms, unless defined otherwise in context, include plural forms. Throughout the specification, it should be understood that the terms "comprise", "have", and the like are used herein to specify the presence of stated features, numbers, steps, operations, elements, components or combinations thereof but do not preclude the presence or addition of one or more other features, numbers, steps, operations, elements, components, or combinations thereof.

Hereinafter, a liquid container including a single cap structure according to one embodiment of the present invention will be described with reference to the drawings.

Figure 1:
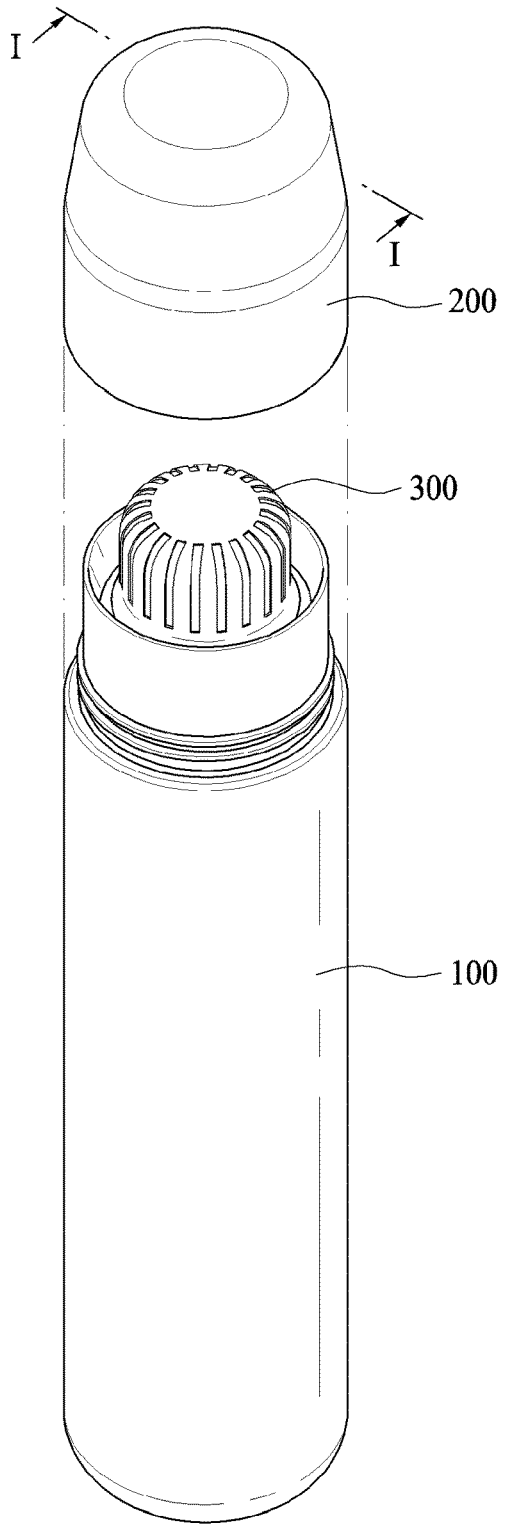
FIG. 1 is a perspective view of a liquid container including a single cap structure according to one embodiment of the present invention.
Figure 2:
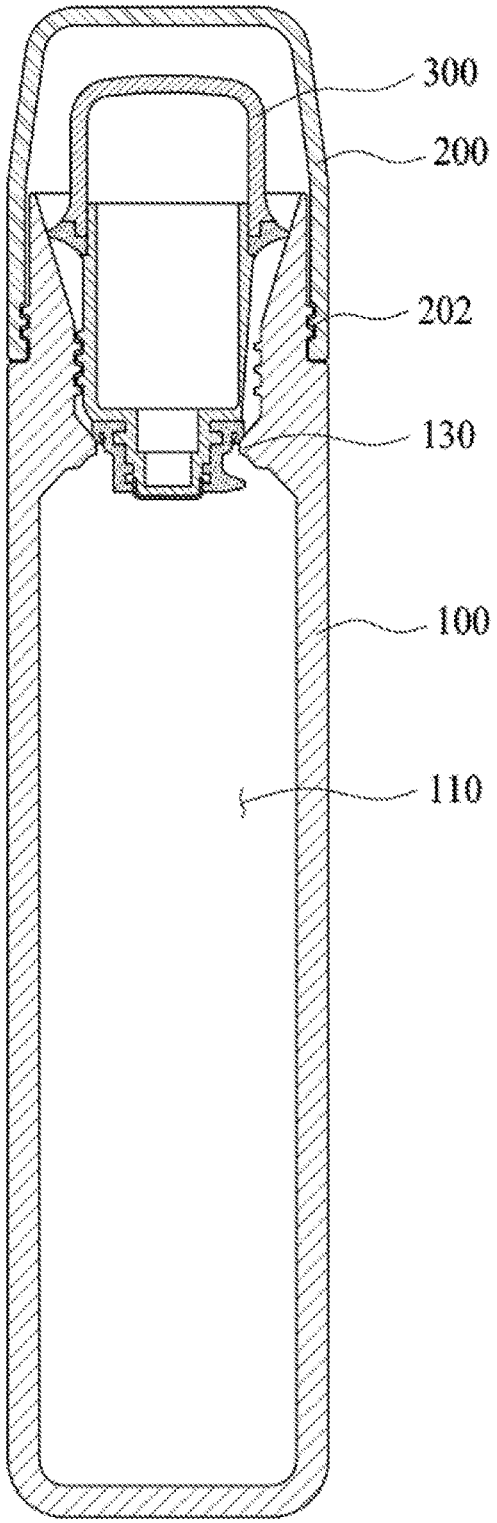
FIG. 2 is a cross-sectional view of the liquid container including the single cap structure according to one embodiment of the present invention taken along line I-I of FIG. 1.
Figure 3:
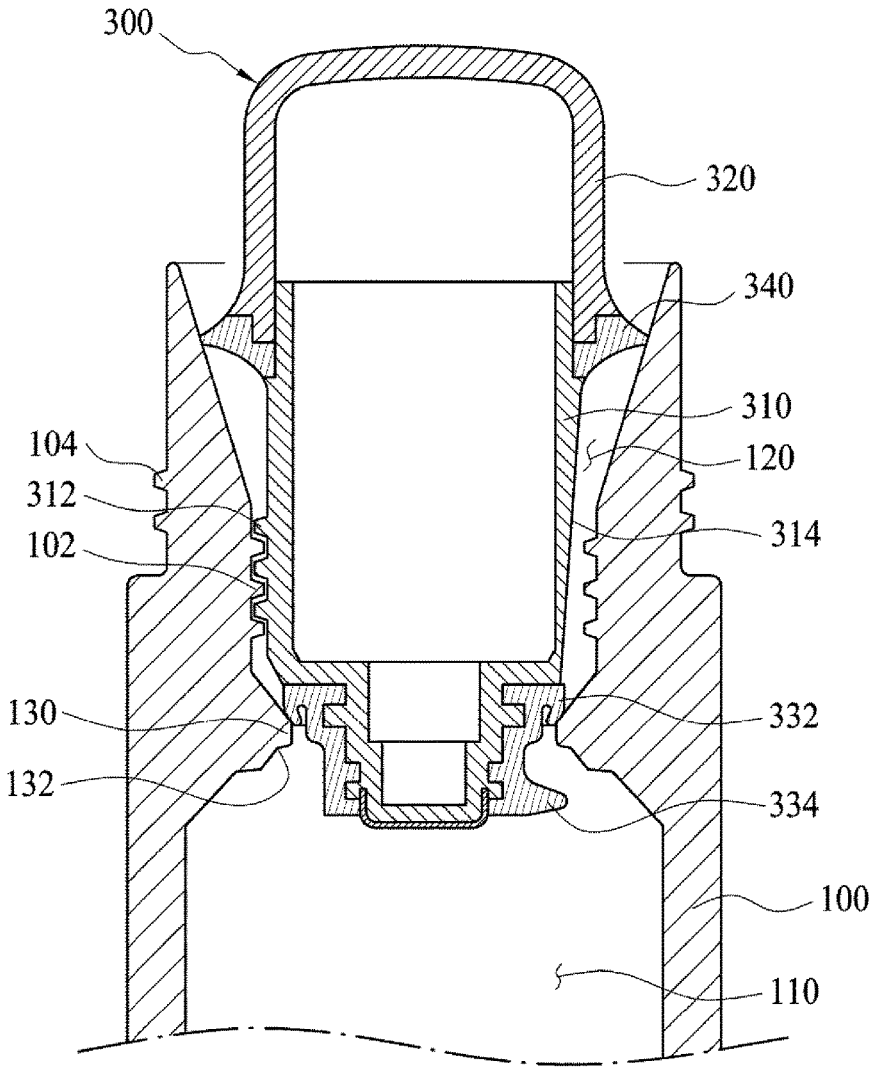
FIG. 3 is a cross-sectional view taken along line I-I of FIG. 1 illustrating a state in which a cap of the liquid container including the single cap structure according to one embodiment of the present invention is closed.
Figure 4:
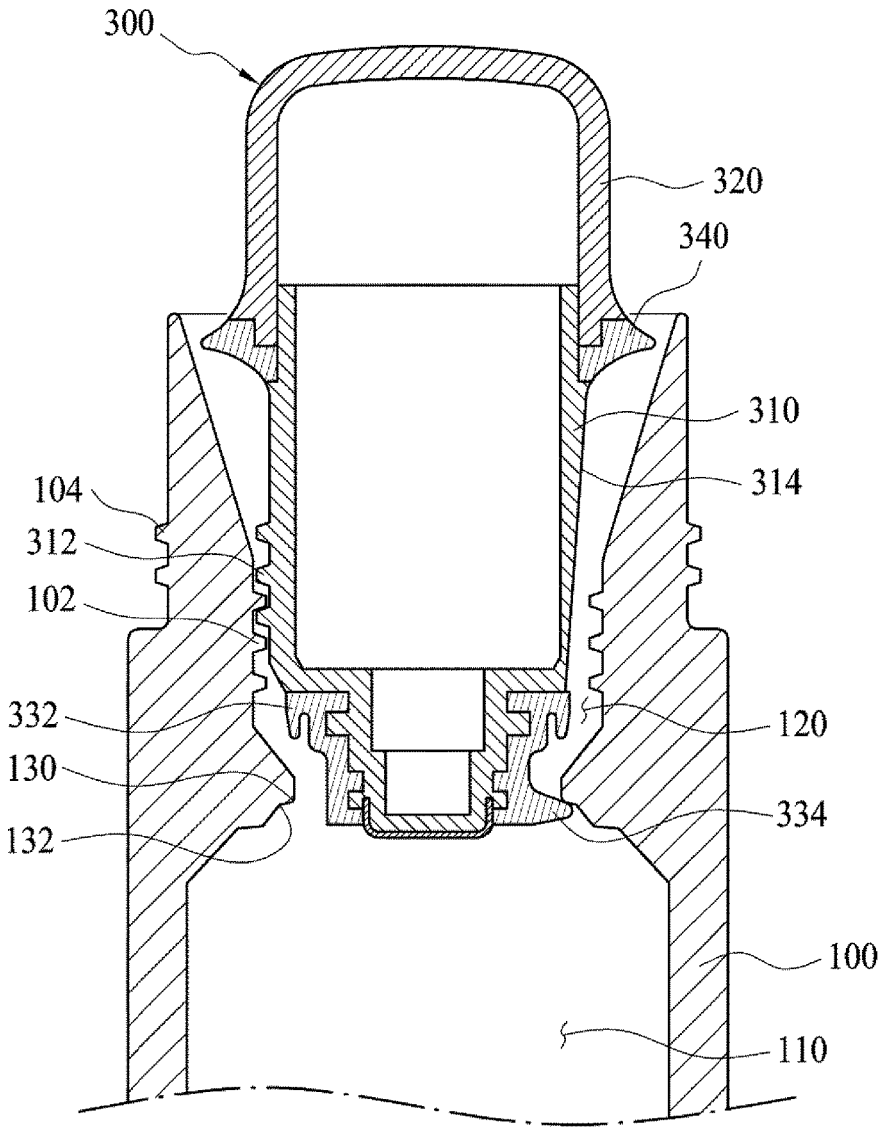
FIG. 4 is a cross-sectional view taken along line I-I of FIG. 1 illustrating a state in which the cap of the liquid container including the single cap structure according to one embodiment of the present invention is opened.
Figure 5:
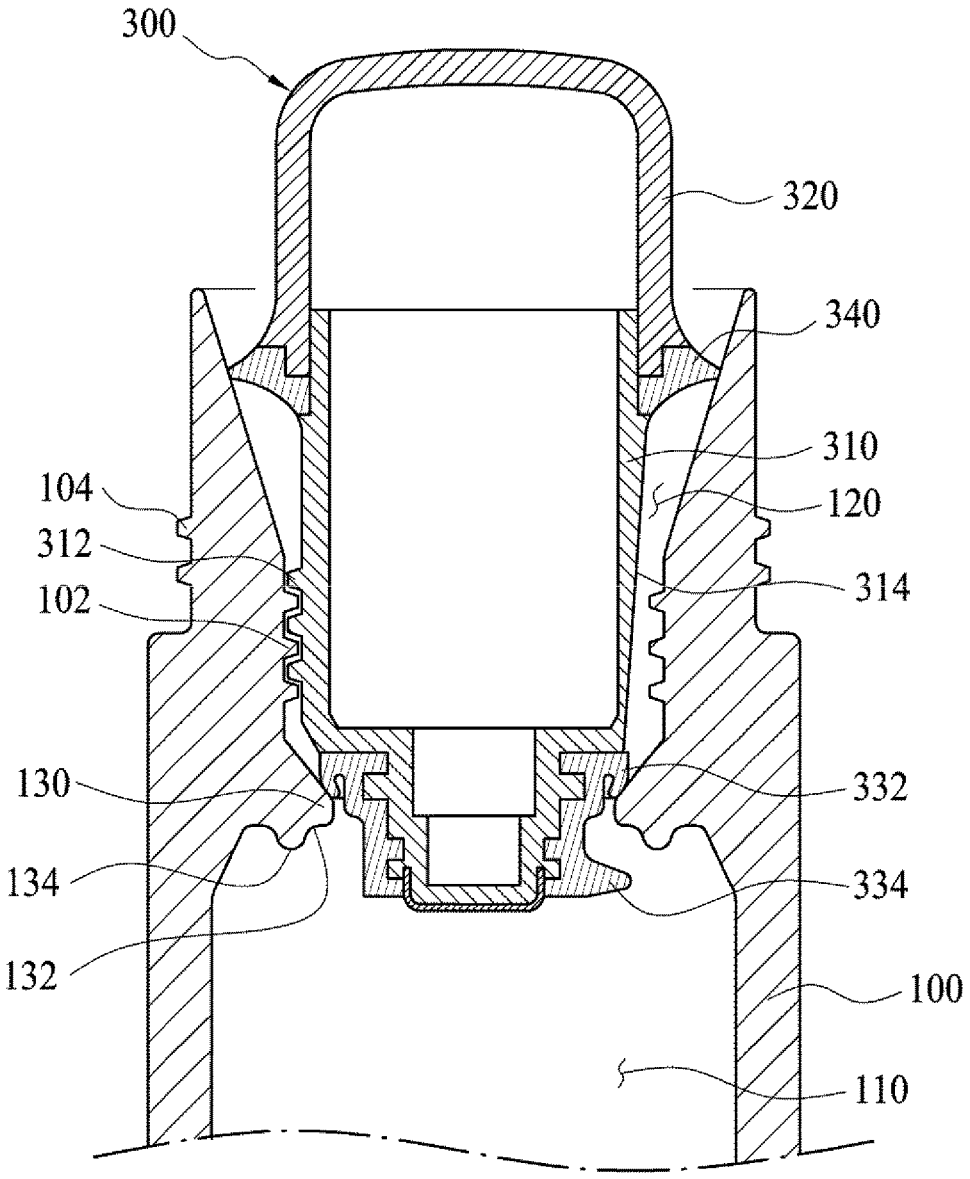
FIG. 5 is a cross-sectional view taken along line I-I of FIG. 1 illustrating another example of a stopper accommodation groove of a liquid container including a double cap structure according to one embodiment of the present invention.
Figure 6:
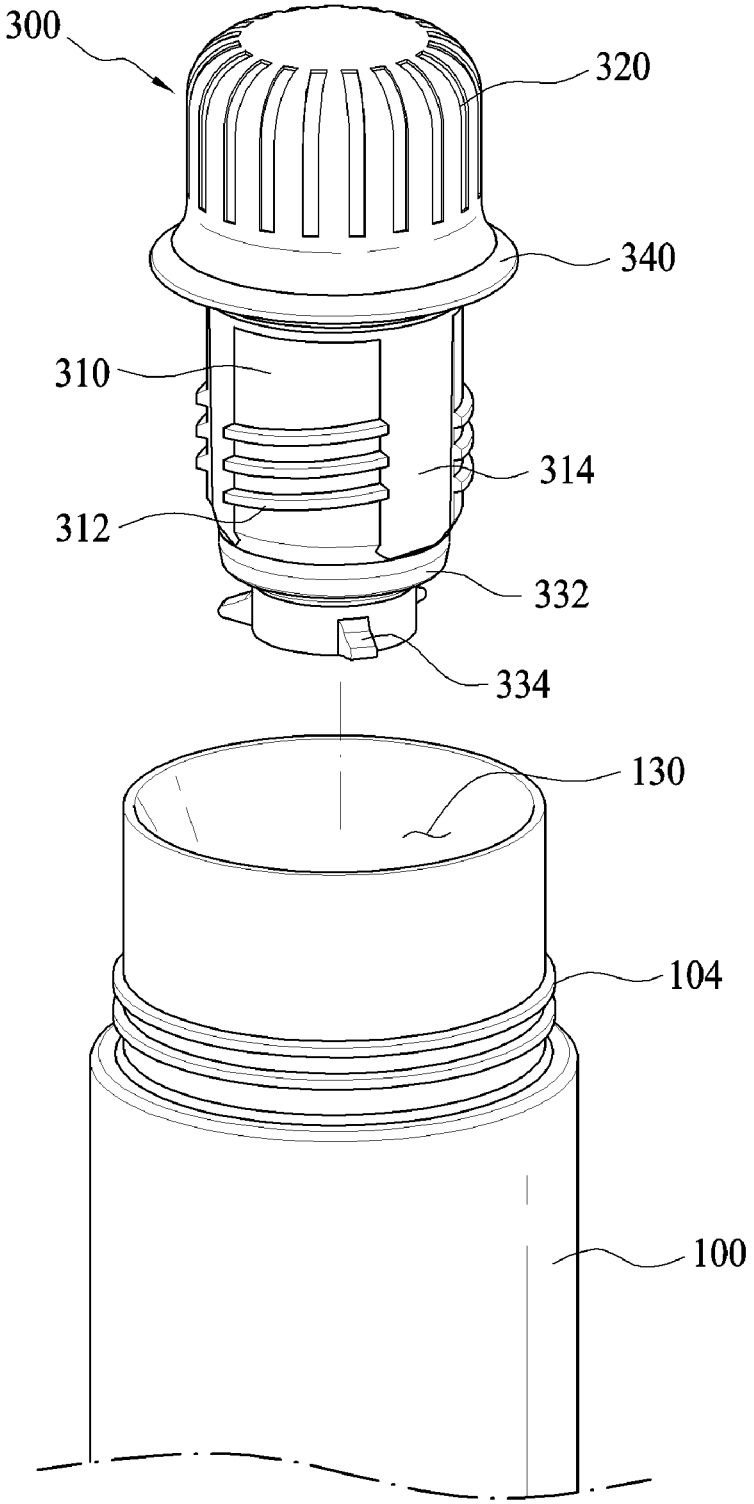
FIG. 6 is an exploded perspective view illustrating an outer cap and an inner cap of the liquid container including the double cap structure according to one embodiment of the present invention.
Figure 7:
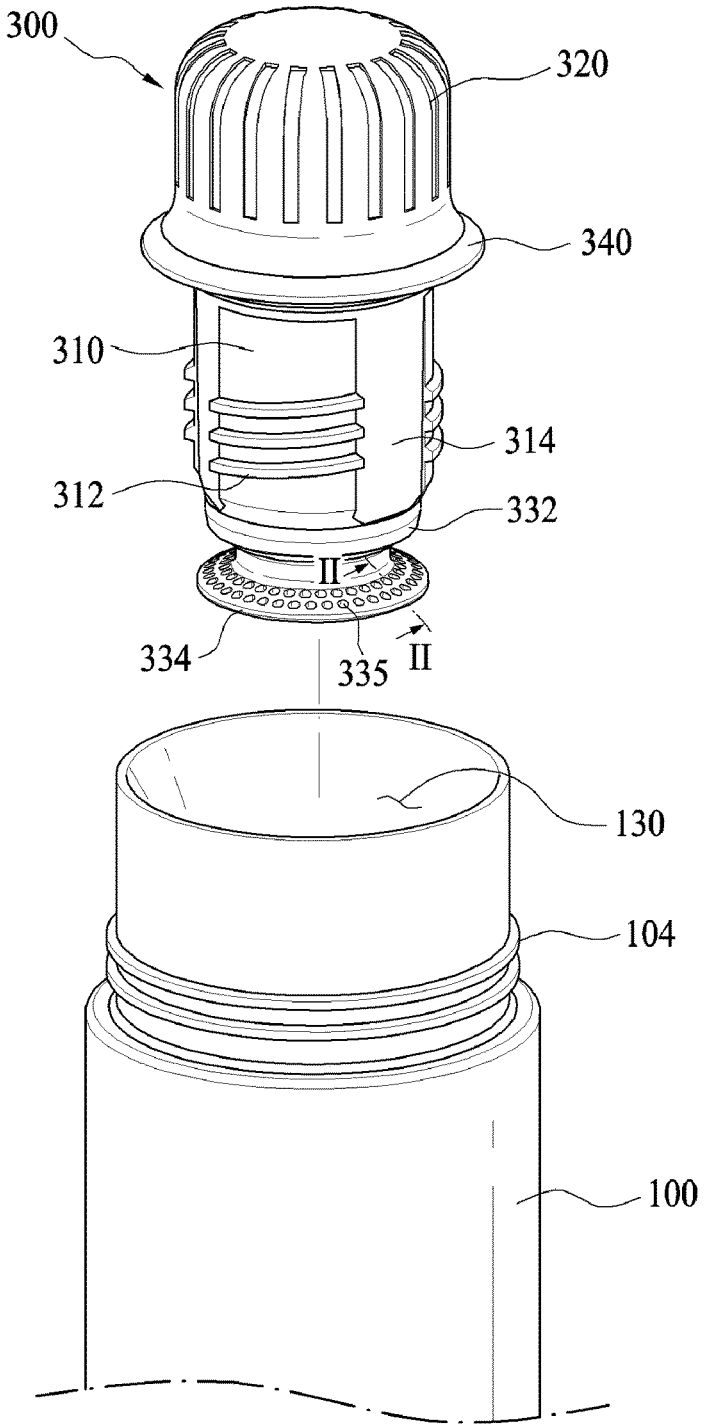
FIG. 7 is an exploded perspective view illustrating another example of a stopper of the liquid container including the double cap structure according to one embodiment of the present invention.

FIG. 1 is a perspective view of a liquid container including a single cap structure according to one embodiment of the present invention, FIG. 2 is a cross-sectional view of the liquid container including the single cap structure according to one embodiment of the present invention, FIG. 3 is a cross-sectional view illustrating a state in which a cap of the liquid container including the single cap structure according to one embodiment of the present invention is closed, FIG. 4 is a cross-sectional view illustrating a state in which the cap of the liquid container including the single cap structure according to one embodiment of the present invention is opened, FIG. 5 is a cross-sectional view illustrating another example of a stopper accommodation groove of a liquid container including a double cap structure according to one embodiment of the present invention, FIG. 6 is an exploded perspective view illustrating an outer cap and an inner cap of the liquid container including the double cap structure according to one embodiment of the present invention; and FIG. 7 is an exploded perspective view illustrating another example of the outer cap and the inner cap of the liquid container including the double cap structure according to one embodiment of the present invention.

As shown in FIGS. 1 to 7, a liquid container including a single cap structure according to one embodiment of the present invention includes a container body 100, an external cover 200, and a cap 300.

The container body 100 is for accommodating a liquid, more particularly, a beverage and includes an inner space 110 which accommodates the liquid and a liquid port 120 formed thereabove to allow the liquid to move into or out of the inner space 110. In the embodiment, an upper part of the liquid port 120 may be formed to allow a diameter thereof to become greater to the top. The liquid port 120 may have an upper diameter that is greater than a lower diameter. Due to this, when the container body 100 is tilted to discharge the liquid, it is possible to prevent the liquid from flow along a handle portion 320 of the cap 300.

In the embodiment, a holding protrusion 130 which protrudes inward may be formed between the inner space 110 and the liquid port 120. In other words, the inner space 110 and the liquid port 120 may be distinguished from each other by the holding protrusion 130. The holding protrusion 130 may be in contact with the cap 300, which will be described below, to prevent the liquid accommodated in the inner space 110 from leaking between the container body 100 and the cap 300. A stopper accommodation groove 132 may be formed at an edge of the liquid port 120 on a bottom surface of the holding protrusion 130. Also, when the cap 300 is opened, a stopper 334, which will be described below, may be supported by the stopper accommodation groove 132 to limit a movement distance of the cap 300.

For example, as shown in FIGS. 3 and 4, the stopper accommodation groove 132 may be formed to be recessed at the edge of the liquid port 120 on the bottom surface of the holding protrusion 130. Otherwise, as shown in FIG. 5, on the bottom surface of the holding protrusion 130, an annular protrusion 134 may be formed at the edge of the liquid port 120 to protrude downward, and the stopper accommodation groove 132 in which the stopper 334 is accommodated may be formed on an inside of the annular protrusion 134.

A diameter of the stopper accommodation groove 132 may be formed to be larger than an outer perimeter of the stopper 334. Accordingly, the stopper 334 may be accommodated in the stopper accommodation groove 132 to move the stopper 334 to a central position. The stopper 334 is positioned at a center of the stopper accommodation groove 132 such that the cap 300 may be positioned at a center of the liquid port 120. That is, the stopper accommodation groove 132 may function as a centralizer of the cap 300. Due to this, since the cap 300 does not lean to one side despite an operation of tilting the container body 100, the liquid may be discharged in all directions of 360 degrees. The stopper 334 will be described in detail.

Meanwhile, a coupling screw 102 for coupling with the cap 300 may be formed at the container body 100 on an inner circumferential surface of the liquid port 120. Also, a screw 104 for coupling with the external cover 200 may be formed on an outer circumferential surface of the liquid port 120.

The external cover 200 is coupled with a top of the container body 100 and for this may include a screw 202 to be coupled with the screw 104 formed at the container body 100. Also, the external cover 200 may be provided to cover the cap 300 at an outside thereof to prevent an inflow of foreign substances from the outside into the container body 100 and prevent the cap 300 from being contaminated. Also, the liquid in the container body 100 may be prevented from leaking out thereof. The external cover 200 may be separated from the container body 100 and be used as a cup.

Meanwhile, as shown in FIG. 3, the cap 300 is inserted into the liquid port 120 and fastened to the container body 100 to open and close the liquid port 120 to selectively connect the inner space 110 to the outside. The cap 300 may include an insertion portion 310 inserted into the liquid port 120 and positioned in the container body 100 and the handle portion 320 positioned above the insertion portion 310 and exposed outside the container body 100 to be gripped by a user to rotate the cap 300.

A coupling screw 312 for being coupled with the coupling screw 102 formed on an inner circumferential surface of the container body 100 may be formed to protrude from an outer circumferential surface of the insertion portion 310. That is, when screw-coupling of the cap 300 is released by rotation, the cap 300 moves upward with respect to the container body 100 to open the liquid port 120. On the other hand, when the cap 300 rotates in an opposite direction and screw-coupled with the container body 100, a bottom end thereof comes into close contact with the holding protrusion 130 of the container body 100 to close the liquid port 120.

A first sealing portion 332 may be provided at a part in contact with the holding protrusion 130, at a bottom end of the insertion portion 310, to seal the inner space 110 when the cap 300 is completely closed. The first sealing portion 332 may be formed of an elastic material and be compressed by the holding protrusion 130 to block in/out flows of liquid when the cap 300 is closed. To increase a sealing effect, the first sealing portion 332 may include an elastic protrusion which is pressurized by the holding protrusion 130 and deformed in an inward-radial direction when the cap 300 is completely closed.

Also, a second sealing portion 340 may be provided between the insertion portion 310 and the handle portion 320 to prevent a liquid present between the cap 300 and the container body 100 from leaking outward when the cap 300 is completely closed. The second sealing portion 340 may protrude outside the cap 300 and may be formed of an elastic material. Also, since the second sealing portion 340 comes into contact with the inner circumferential surface of the container body 100 and is compressed when the cap 300 is completely closed, an outflow of the liquid may be prevented. When the cap 300 is opened, the liquid port 120 may be opened and the liquid may be discharged outward.

The first sealing portion 332 and the second sealing portion 340 may be formed of rubber, silicone, and the like but are not limited thereto.

Also, the insertion portion 310 includes the stopper 334, which limits the movement distance of the cap 300 when the cap 300 moves upward, at a position spaced at a certain interval apart from a bottom surface of the insertion portion 310. Due thereto, when the cap 300 moves upward by a certain distance due to rotation, the stopper 334 may be held and supported by the holding protrusion 130 such that a movement of the cap 300 may be limited.

For this, the stopper 334 may protrude in an outward-radial direction and be formed such that a plurality of lines or surfaces of the stopper 334 come into contact with the stopper accommodation groove 132 when the cap moves upward.

For example, the stopper 334 may have a shape including a plurality of protrusions which are spaced at certain angles apart and protrude in the outward-radial direction. The plurality of protrusions may include three or more protrusions. Due thereto, even when the container body 100 is tilted in any one direction, the cap 300 may be supported by the stopper accommodation groove 132 due to the stopper 334. Accordingly, it may be prevented that the cap 300 leans to a direction in which the container body 100 is tilted to interfere in discharging of the liquid.

Otherwise, as shown in FIG. 7, the stopper 334 may have a circular plate shape which protrudes in the outward-radial direction and may include holes 335 through which the liquid passes, to discharge the liquid outward. That is, the stopper 334 may have a filter shape. Due the above-described shape, the stopper 334 may filter out tea leaves or may prevent foreign substances included in the liquid from being discharged outward with the liquid.

The stopper 334 may be accommodated in the stopper accommodation groove 132 and restricted in a horizontal movement. An upper surface of the stopper 334 may be upwardly projected and directly accommodated in the stopper accommodation groove 132. Due thereto, the cap 300 may be located in a dead center of the liquid port 120 to allow the liquid to be discharged in all directions regardless of a direction in which the container body 100 is tilted.

Figure 8:
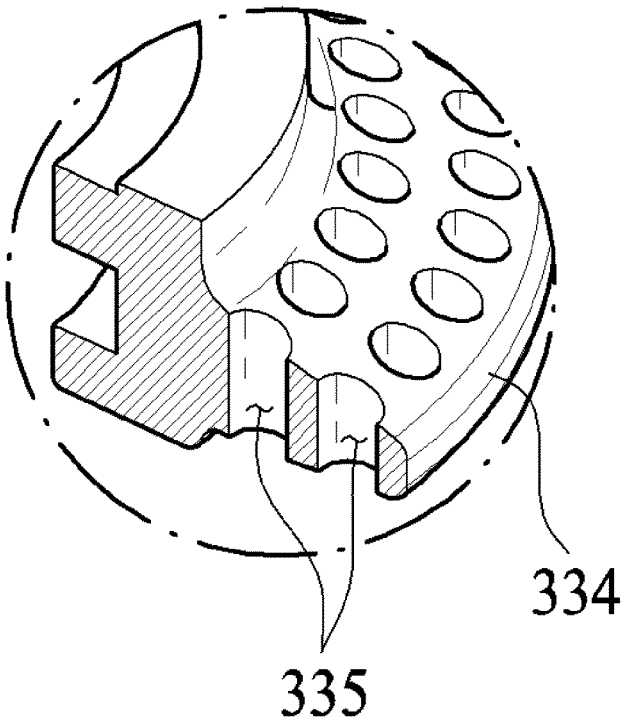
FIG. 8 is a cross-sectional view taken along line II-II of FIG. 7.

In the embodiment, as shown in FIG. 8, it has been described as an example that the stopper 334 has a protrusion shape or a circular plate shape with the holes 335. However, the shape of the stopper 334 is not limited to the above description and may include any shapes capable of being accommodated in the stopper accommodation groove 132 and restricting the movement distance of the cap 300 and simultaneously smoothly discharging the liquid.

In the embodiment, the stopper 334 is formed of an elastic material such that the cap 300 may be separated from the container body 100 by a certain external force applied to the cap 300. In other words, when the cap 300 is rotated by applying a greater force to the cap 300 while the stopper 334 is in contact with the stopper accommodation groove 132, the stopper 334 may be deformed and the cap 300 may be separated from the container body 100. Due thereto, the container body 100 and the cap 300 may be easily washed, and the cap 300 may be removed such that the container body 100 may be refilled with a liquid through the liquid port 120.

The stopper 334 may be integrated or uniformly formed with the above-described first sealing portion 332 and may be detachably coupled with a bottom of the insertion portion 310. In this case, there is provided an advantage in which it is possible to wash and replace components. Otherwise, the stopper 334 and the first sealing portion 332 may be double injection-molded to the cap 300. Otherwise, the stopper 334 and the first sealing portion 332 may be formed separately from each other and may be assembled with each other.

Meanwhile, an extraction flow path 314 may be formed on the outer circumferential surface of the insertion portion 310. When the cap 300 is opened, the extraction flow path 314 may connect the inner space 110 to the outside to allow a liquid to be discharged outward through the extraction flow path 314. The extraction flow path 314 may have a groove shape which has a length in a height direction of the cap 300 and is recessed in a vertical direction inside the cap 300 at a certain depth. That is, the coupling screw 312 formed at the insertion portion 310 may be cut off by the extraction flow path 314.

Due thereto, when the cap 300 is opened any bit, a space may be formed between the holding protrusion 130 and the first sealing portion 332 and may be connected to the extraction flow path 314. Also, the extraction flow path 314 may be connected to a space between the inner circumferential surface of the container body 100, at which the coupling screw 102 is not formed, and the outer circumferential surface of the insertion portion 310. Due thereto, a liquid which flows through the extraction flow path 314 may be discharged in all directions of 360 degrees.

As described above, the liquid container including the single cap structure according to one embodiment of the present invention has been described.

Hereinafter, coupling and releasing between the container body 100 and the cap 300 of the liquid container including the single cap structure according to one embodiment of the present invention will be described.

When the cap 300 is coupled with the container body 100, first, the cap 300 may be inserted into the liquid port 120 and rotated to be coupled therewith. When the stopper 334 comes into contact with the holding protrusion 130, the cap 300 may be rotated with a greater force. Due thereto, the stopper 334 formed of an elastic material may be deformed to pass through the holding protrusion 130 and may be inserted into the inner space 110. Also, in this state, when the cap 300 is rotated until not to be rotated any more, as shown in FIG. 4, the first sealing portion 332 is compressed such that a gap between the container body 100 and the cap 300 may be completely sealed.

On the other hand, when the cap 300 is opened to discharge a liquid, the cap 300 is rotated to release screw-coupling thereof. As shown in FIG. 5, when the stopper 334 comes into contact with the stopper accommodation groove 132, the cap 300 is located in the center of the liquid port 120 and the extraction flow path 314 is opened to become a state of discharging the liquid in all directions.

Here, when the container body 100 is tilted, the liquid accommodated in the inner space 110 may flow into a space between the container body 100 and the cap 300 through the extraction flow path 314 and may be discharged in all directions of 360 degrees.

When the cap 300 is rotated with a greater force while the stopper 334 is in contact with the stopper accommodation groove 132, the stopper 334 may be deformed to separate the cap 300 from the container body 100.

According to the above-described embodiments of the present invention, there are provided effects as follows.

First, in a liquid container including a single cap structure according to one embodiment of the present invention, since a stopper is provided on a bottom surface of a cap, at a position spaced at a certain distance apart from the bottom surface of the cap to be supported by a holding protrusion formed in a container body to limit a movement distance of the cap when the cap moves up by a certain distance or more, the cap may be prevented from being separated when a liquid is discharged.

Second, in a liquid container including a single cap structure according to one embodiment of the present invention, since a stopper accommodation groove in which a stopper is accommodated is formed on a bottom surface of a holding protrusion and functions as a centralizer to allow a cap to be constantly positioned at a center of a liquid port, the cap does not lean to one side even when a container body is tilted such that a liquid may be discharged in all directions of 360 degrees.

Third, in a liquid container including a single cap structure according to one embodiment of the present invention, since a stopper is formed of an elastic material, when a certain external force is applied to a cap, the stopper is deformed and the cap is separated from a container body such that washing, replacing, drink-refilling, and the like may be easily performed.

Effects of the present disclosure will not be limited to the above-mentioned effects and other unmentioned effects will be clearly understood by those skilled in the art from the following claims.

Although the exemplary embodiment of the present invention has been described above, it is obvious to one of ordinary skill in the art that the present invention may be embodied as other particular forms in addition to the above-described embodiment without departing from the purpose or scope of the present invention. Therefore, the above-described embodiment should be considered to be exemplary rather than limitative and thus the present invention is not limited to the above description and may be modified within the scope of the following claims and equivalents thereof.

What is claimed is:

1. A liquid container comprising:

a container body comprising an inner space and a liquid port being formed on top of the inner space, wherein a holding protrusion which protrudes inward formed between the inner space and the liquid port so that the inner space and the liquid port are distinguished each other by the holding protrusion, wherein a coupling screw is formed on an inner circumferential surface of the container body, wherein the liquid port has an upper diameter that is greater than a lower diameter, and wherein a stopper accommodation groove is formed on a bottom surface of the holding protrusion;

a cap comprising an insertion portion inserted into the liquid port and with an extraction flow path formed on an outer circumferential surface of the insertion portion, the extraction flow path being recessed in a vertical direction, a handle portion located above the insertion portion and exposed outward from the container body, and a first sealing portion formed of an elastic material at a bottom end of the insertion portion and compressed by the holding protrusion to seal the inner space when the cap is completely closed; and a stopper is uniformly formed with the first sealing portion and protrudes in an outward radial direction, wherein the stopper is configured to be accommodated in the stopper accommodation groove when the cap moves upward so that a horizontal movement of the stopper is prevented, and formed of an elastic material to allow the cap to be removable from the container body, wherein an upper portion of the stopper is upwardly projected and directly accommodated in the stopper accommodation groove.

2. The liquid container of claim 1, wherein the cap further comprises a second sealing portion formed of an elastic material between the insertion portion and the handle portion and extended along an outer diameter to protrude outward to come into contact with the inner circumferential surface of the container body to be compressed when the cap is completely closed.

* * * * *